United States Patent [19]

Van Luik, Jr. et al.

[11] Patent Number: 4,919,343

[45] Date of Patent: Apr. 24, 1990

[54] ANTI-FLOODING SEWAGE GRINDER PUMP LIQUID LEVEL CONTROL SYSTEM IN SEPARATELY MOUNTED CANISTER

[75] Inventors: Frank W. Van Luik, Jr.; Eric F. Cabahug, both of Schenectady, N.Y.

[73] Assignee: Environment/One Corporation, Schenectady, N.Y.

[21] Appl. No.: 412,225

[22] Filed: Sep. 25, 1989

[51] Int. Cl.[5] ..... B02C 23/36

[52] U.S. Cl. ..... 241/36; 241/46.02

[58] Field of Search ..... 241/36, 46.02; 52/20; 137/363, 395, 544, 567; 405/36, 52, 303; 417/435

[56] References Cited

U.S. PATENT DOCUMENTS

| | | | |
|---|---|---|---|
| Re. 28,104 | 8/1974 | Grace | 241/36 |
| 3,904,131 | 9/1975 | Farrell, Jr. et al. | 241/46.02 |
| 4,014,475 | 3/1977 | Grace et al. | 241/36 |
| 4,822,213 | 4/1989 | Grace et al. | 241/36 X |

*Primary Examiner*—Timothy V. Eley
*Attorney, Agent, or Firm*—Charles W. Helzer

[57] ABSTRACT

An anti-flooding sewage grinder pump liquid level control system in a separately mounted canister is provided for installation within and controlling operation of a sewage grinder pump installed within a sewage collection tank. Within the control canister, pneumatically operated electric control switches for controlling on/-off operation of the sewage grinder pump and for redundant pump down of alarm high level flooding conditions, are provided. The control switches are mounted within one or more diving bell-type containment vessels for preventing flooding of the electric control switches in case of surge overloads of liquid sewage or failure of the primary on/off pneumatic/electrical control switch. In the event of flooding, the containment vessel will pressurize air in the top of the containment vessel and will actuate the alarm level control switch. The alarm level control switch is wired to provide redundant excitation to the sewage grinder pump motor. As a consequence, alarm liquid level conditions are pumped down to just above the normal operating range of the sewage grinder pump cyclically as long as the condition continues. The pressurized air trapped within the diving bell-type containment vessel also will prevent rising of the flood waters within the containment vessel so as to protect the control switches from being flooded. As a result, the system will continue to operate even during alarm flood conditions to pump down the collection tank cyclically without requiring separate service measures to do so. After pump down of the contents of the collection tank to below alarm levels, the system automatically will return to its normal on/off control operating mode without requiring service or maintenance of any kind. During any flooding condition while the alarm level control switch is on, an alarm light is continuously lighted and a user option alarm sound signal is sounded even after the pump down to below the alarm high level occurs.

20 Claims, 4 Drawing Sheets

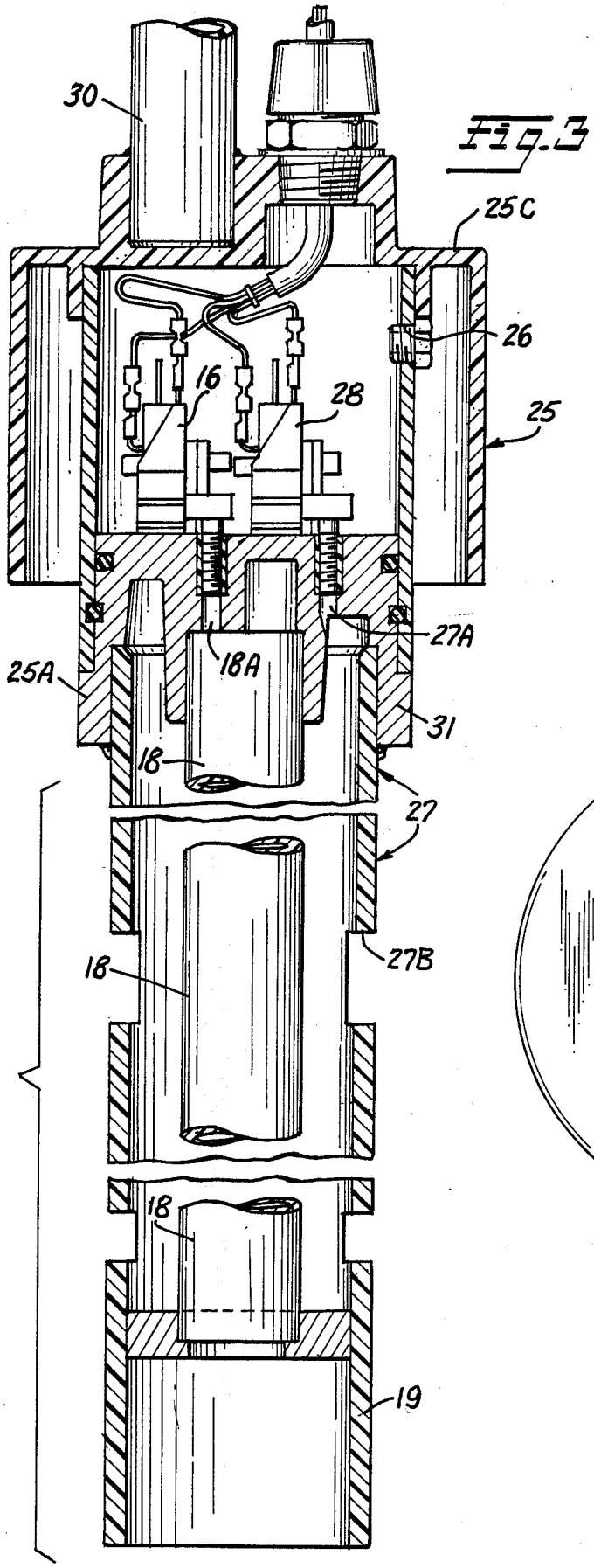
Fig. 3
Fig. 4
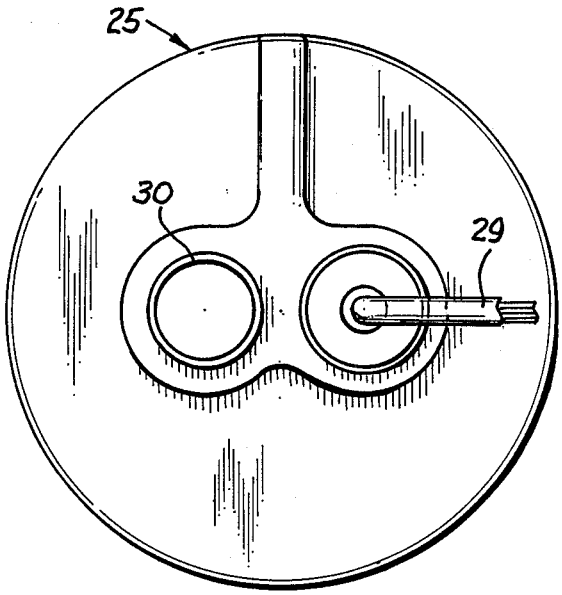

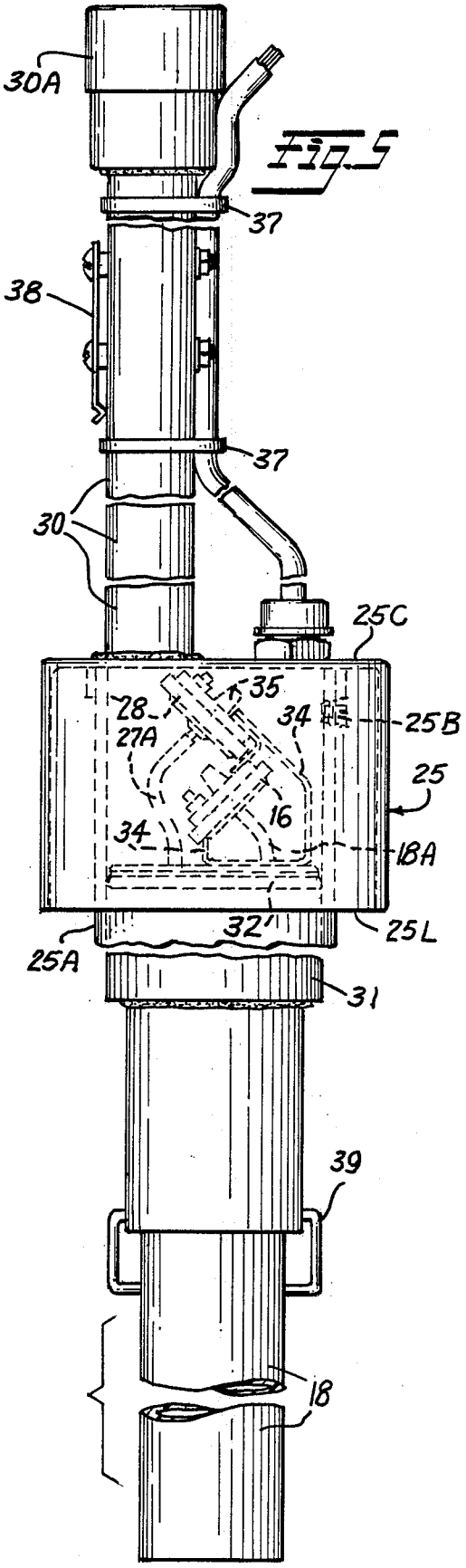
Fig. 5
Fig. 6
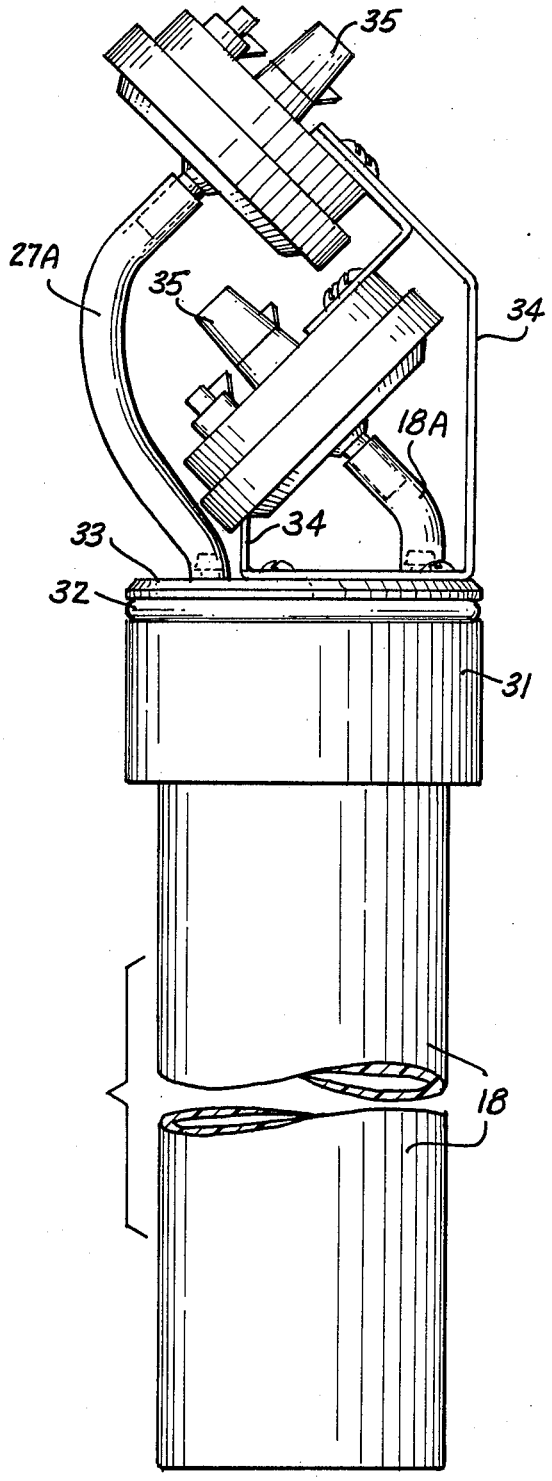

45
42
40
44
43
L
44
29
15A
M
16
28
POWER SOURCE

ANTI-FLOODING SEWAGE GRINDER PUMP LIQUID LEVEL CONTROL SYSTEM IN SEPARATELY MOUNTED CANISTER

TECHNICAL FIELD

This invention relates to sewage grinder pumps and to the controls therefore.

More specifically, the invention relates to a new and improved sewage grinder pump liquid level control system employing pneumatically operated electric control switches for controlling on/off operation of a sewage grinder pump (sgp).

BACKGROUND OF INVENTION

Prior art sewage grinder pumps, such as disclosed in U.S. Pat. No. 4,014,475 issued Mar. 29, 1977, for a "Combined Manway and Collection Tank for Sewage Grinder", Richard C. Grace et al inventors, assigned to Environment/One Corporation, employs an inverted diving bell-type airtight and liquid-tight enclosure for supporting a pressurized air column that operates a pneumatic/electric switch to control the normal on/off operating levels of the sewage grinder pump (sgp). A separate alarm overflow level sensing and alarm indicating pneumatic/electric switch also is included in the sgp system. This known control arrangement is satisfactory in many respects for operating the sewage grinder pump (sgp) but requires that one side of the pneumatic/electric switches be vented to atmosphere to prevent false indications of water level due to ambient pressure changes and/or unbalanced pressures within the collection tank containing the sgp. This vent normally has taken the form of a flexible, small diameter, plastic tube, the entrance to which is located high up in the tankage and is subjected to ambient pressures. Even when proper venting is obtained, because the collection tank presently used is comprised of a sealed basin and a vented accessway as disclosed in Pat. No. 4,014,475, rapid pressure variations in the sealed basin portion of the collection tank can cause false indications. To overcome this problem a timed delay relay is required in the starting/relay circuitry for the sgp motor. These features add complications to the design of the sewage grinder pump system, its controls, and the collection tank, and often lead to a rather messy installation which leaves electric conductors and venting tubes hanging loose within the collection tank.

To overcome these problems, the present invention was devised.

SUMMARY OF INVENTION

It is therefore a principal object of the present invention to provide a novel sewage grinder pump liquid level sensing and control system contained within a single canister wherein the pneumatically operated electric control switches for controlling on/off operation of the sewage grinder pump are physically supported within a sewage collection tank separately from the sewage grinder pump. The liquid level control system canister includes at least one liquid-tight and airtight diving bell-type containment vessel within which the pneumatically operated electric control switches are mounted for preventing flooding of the electric control switches in case of overfilling of the collection tank due to liquid surges or failure of the primary on/off operating control switch.

Another object of the invention is to so interconnect the normal level on/off sgp pneumatic control electric switch with the alarm level pneumatic electric control switch so that redundant excitation of the sgp motor is provided during extreme high water alarm level conditions caused by the failure of the normal operating level control on/off switch or a high water surge.

In practicing the invention, a sewage grinder pump system is provided having a collection tank and a grinder pump driven by an electric motor disposed therein for grinding and discharging sewage collected in the tank under pressure through a pressurized sewage discharge outlet. The improvement comprises first pneumatic and electrically operable liquid sewage level sensing and control means calibrated for sensing a normal operating high liquid sewage level within the collection tank and automatically electrically exciting the grinder pump electric motor to cause the pump to grind and pump down sewage collected in the tank to a normal low operating level. Second pneumatic/electric alarm liquid sewage level sensing and control means is provided which is calibrated for sensing an alarm high liquid sewage level within the collection tank which is higher than the normal operating high liquid sewage level and representative of overfilling of the collection tank due to a malfunction or surge overload. The second alarm liquid sewage level sensing and control means is electrically connected to and automatically provides an alarm operating condition indication signal to an operator of the sewage grinder pump system. To complete the system, means are provided for physically mounting both of the first normal operating liquid sewage level sensing and control means and the second alarm liquid sewage level sensing and control means within a liquid-tight and airtight diving bell-type enclosure means having an open lower end thereof exposed to and normally closed by the upper level of the collected liquid sewage contained in the sewage collection tank during both normal operating conditions and alarm high liquid sewage level operating conditions.

In preferred embodiments of the invention, the normal operating level on/off sewage grinder pump pneumatic control electric switch is so interconnected with the alarm level control switch that redundant excitation of the sewage grinder pump motor is provided during extreme high water alarm conditions caused by a failure of the normal operating on/off control switch or a high water surge.

BRIEF DESCRIPTION OF DRAWINGS

These and other objects, features and many of the attendant advantages of this invention will be appreciated more readily as the same becomes better understood from a reading of the following detailed description, when considered in connection with the accompanying drawings, wherein like parts in each of the several figures are identified by the same reference characters, and wherein:

FIG. 3 is a longitudinal sectional view of an embodiment of the invention which employs two separate diving bell-type liquid tight and air tight enclosures for use in providing actuation and protection for the pneumatically operated electric control on/off switches employed in controlling operation of a sgp;

FIG. 4 is a top plan view of the liquid level sensing and control system shown in FIG. 2;

FIG. 5 is a side elevational view of a second and preferred embodiment of the invention which employs only a single diving bell-type enclosure in place of the two enclosures used in the embodiment of the invention shown in FIG. 3;

FIG. 6 is a side elevational view of the sensor tube and pneumatic/electrical control switch mounting assembly used in the embodiment of the invention shown in FIG. 5.

BEST MODE OF PRACTICING INVENTION

Figure 1:
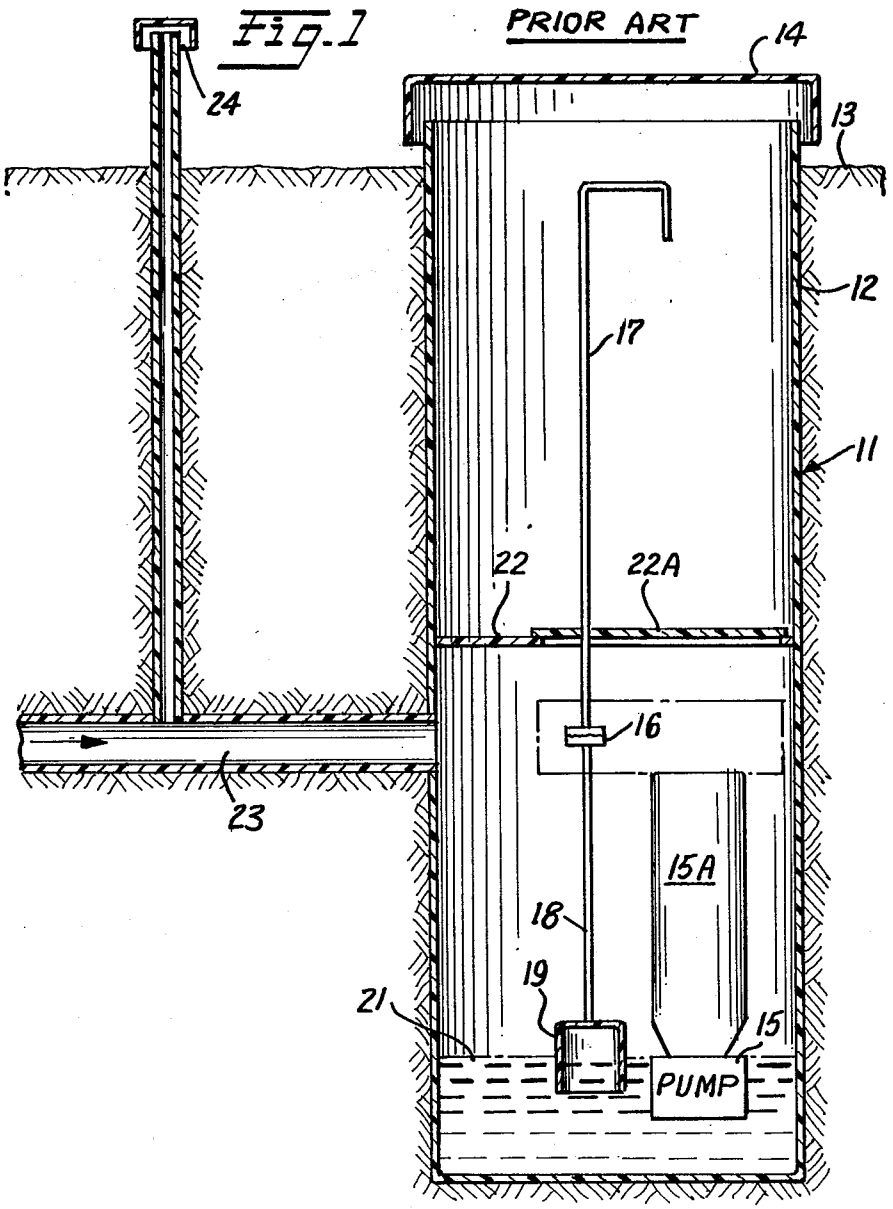
PRIOR ART Fig. 1
FIG. 1 is a diagrammatic sketch of certain of the pertinent features of a prior art sewage grinder pump system similar to the one described in U.S. Pat. No. 4,014,475.

FIG. 1 is a functional schematic diagram which illustrates the general features of prior art sewage grinder pump system and also is illustrative of the problem sought to be overcome by the present invention. In FIG. 1 a sewage collection tank is shown at 11, having a manway 12 supported thereon. Manway 12 extends above the surface of the earth 13 and has a top 14 that is vented to the atmosphere. A sewage grinder pump (sgp) is shown at 15 whose pressurized sewage discharge output connections are not shown for simplicity. The sgp is controlled by a pneumatic/electric switch 16 which is mounted high up in the collection tank 11 at a point above both normal high water as well as alarm or flooding high level conditions where the sewage collection tank 11 is substantially full. The pneumatic side of the pneumatic/electric switch 16 is vented to atmosphere through a small diameter, plastic vent tube 17 that extends to a point high up in the manway enclosure 12. The lower pressurized side of the pneumatic switch 16 is connected through a pipe 18 to an inverted bell-type enclosure 19 whose open end is disposed below the normal low surface level of the liquid sewage 21 contained in collection tank 11.

In the above-described arrangement, the liquid level 21 rises through and within the downwardly facing open mouth of bell-type enclosure 19, and pressurizes air trapped in the top of enclosure 19 as well as the air in the connecting tube 18 connected to pneumatic/electric switch 16. The pneumatic/electric switch 16 is set to turn off at a pressure corresponding to a minimum low water level, for example 2 feet in the collection tank, and to turn on at a pressure corresponding to a normal high level, for example 8 feet, of liquid sewage collected in the collection tank 11. It should be further noted that the interconnection between the collection tank 11 and the manway enclosure 12 includes an air tight and liquid tight partition 22 having a normally closed opening 22A therein that maintains the manway 12 free from liquid and odors present in the collection tank 11. Sewage is supplied to the collection tank 11 through a gravity-fed supply conduit 23 of a gravity-fed sewage collecting conduit system connected thereto and vented at various points as shown at 24.

As can be seen from FIG. 1 (and as noted earlier) the pneumatic/electric switch 16 requires that one side of the switch be vented to atmosphere to prevent false indications of accumulated water level due to ambient pressure changes and/or unbalanced pressures within the tankage containing the sewage grinder pump 15. This vent normally takes the form of a flexible, small diameter, plastic tube, the entrance of which is located high up in the manway/accessway 12 and is subject to ambient air pressure changes in the atmosphere. Even when thus properly vented, because the tankage is comprised by the sealed collection tank portion 11 and the vented accessway 12, rapid liquid level and pressure variations in the sealed basin collection portion 11 of the tankage can cause false indications. To overcome this problem, a time delay relay is used in the starting relay circuitry for the pump motor 15A. The addition of all these features adds complications to the design of the pump, its controls and the tankage and often leads to a rather messy installation with the vent tube 17 hanging loose within the manway/accessway 12 along with a number of electric conductors. To avoid these problems, this invention was devised.

Figure 2:
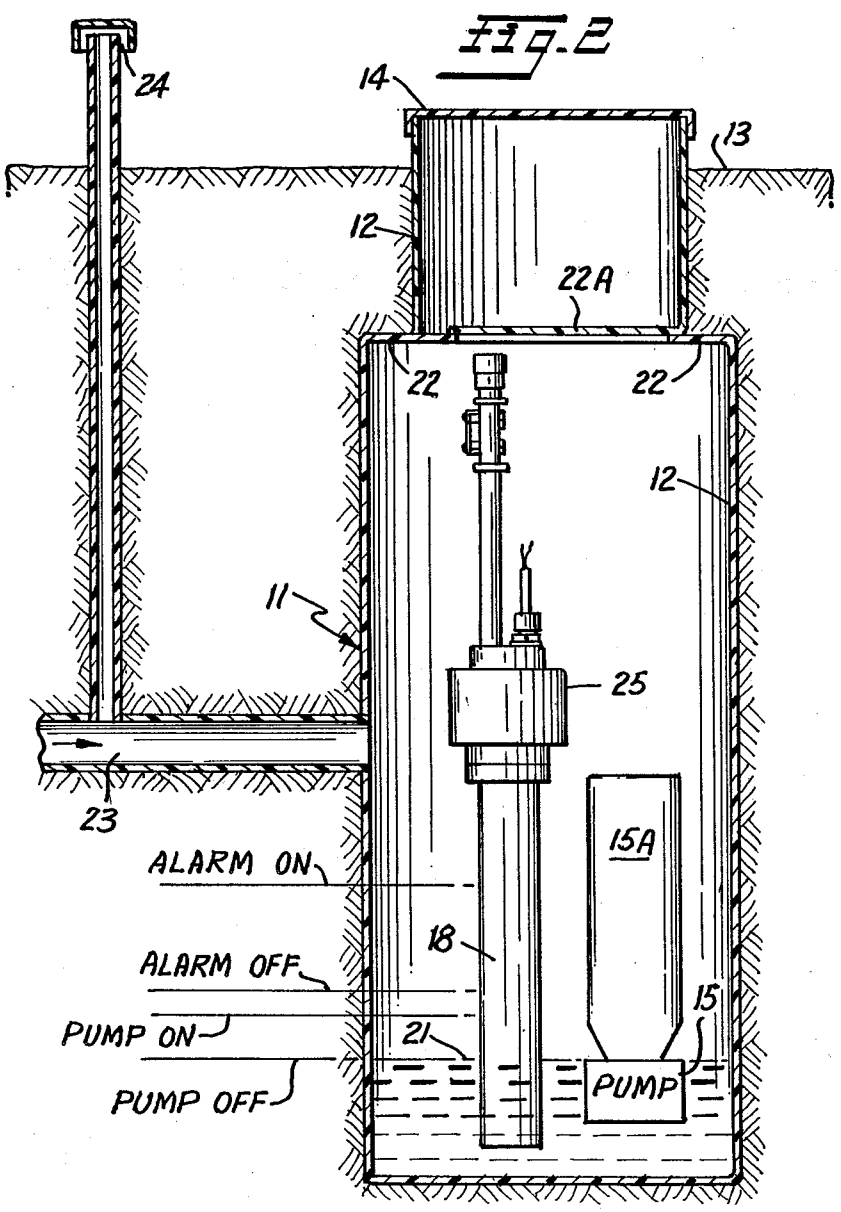
FIG. 2 is a diagrammatic sketch of the essential features of a new and improved sewage grinder pump liquid level sensing and control system according to the invention mounted within a sewage collection tank along with an sgp which it controls.

FIG. 2 of the drawings is a schematic illustration of an embodiment of the invention wherein an additional diving bell-type liquid-tight and airtight enclosure 25 having an open lower end is employed high up in the tankage to correct for pressure changes within the tankage due either to a water surge or ambient atmospheric pressure changes and to protect the control switches. In this embodiment, both the normal operating on/off control switch and the alarm control switch are mounted in diving bell 25 which is located high-up in the sewage collection tank in a manner such that it is well above the normal high water level of the sewage collected in the tank as well as the alarm turn-on level. During normal operating conditions, the interior of diving bell 25 during normal on/off operating is at atmospheric pressure via the tankage, interconnecting conduits 23 and the vents to atmosphere 24. By reason of this construction, the top 14 of the manway 12 and/or the partition 22 between the manway/accessway 12 and tank 11 may be sealed or not sealed depending upon the wishes of the installer and/or user.

The interior of the diving bell enclosure 25 is connected to the ambient air side of both pneumatic/electric control switches with the pressured side of the normal on/off control switch being connected to respond to air pressure built-up in sensor tube 18. With this arrangement, the normal liquid sewage level control of the contents of the sewage collection tank 11 will only be responsive to true liquid level changes in the tanks, and pressure built-up in diving bell 25 can be used for both normal on/off operation of the sgp 15 and for sensing alarm level conditions.

If there is a sudden filling of the sewage collection tank beyond the capacity of the pumping system or if there should be a failure in the normal on/off control switch thereby allowing the tank 11 to fill with liquid to above the alarm level, the diving bell 25 will then serve to actuate the alarm pneumatic/electric control switch. Under these conditions, the diving bell enclosure 25, as water rises into its mouth, will seal off and keep liquid from entering the interior of the diving bell enclosure where the pneumatic/electric control switches are mounted. Because there is a higher pressure head in the diving bell enclosure 25 due to the higher liquid level, the alarm pneumatic/electric control switch turns on its higher pressure calibrated switch under these conditions. The pressurized air trapped in diving bell enclosure 25 protects the control switches and their control functions. Hence, the sgp continues to operate and pump down the contents of the collection tank. When the liquid level within the tank returns to its normal operating level condition, the controls, without any need for maintenance or service, go back to their original operating states.

The advantage of this concept is that the tankage can now either be sealed or not sealed. There is no longer any need for long lengths of flexible tubing inside the tank in order to vent one side of the pneumatic/electric switches to atmospheric pressure. Further, the liquid level control system can be designed as a separate package in a single canister so that it is self-contained and need not be physically connected to the sgp. This provides for more reliable and flexible level control and makes servicing of the sewage grinder pump installation easier. By simple above-ground testing it can be determined readily whether a fault lies in the control system or in the sgp itself thereby making it necessary to raise only one or the other but not both in order to service the installation.

FIG. 3 of the drawings is a longitudinal sectional view of a practical design of a sgp liquid level control system in a self-contained canister according to the invention and FIG. 4 is a top view of the canister. The system shown in FIGS. 3 and 4 illustrate an embodiment of the invention wherein there is a lower diving bell-type enclosure 19 and an upper diving bell-type enclosure 25. In FIG. 3 the lower diving bell 19 is coupled through a normal on/off control sensor tube 18 and a passageway 18A to the pressurized side of a pneumatic/electric on/off control switch 16. A second alarm level sensor tube 27 circumferentially surrounds the normal on/off control sensor tube 18 and is coupled through a passageway 27A to the pressure side of a separate alarm pneumatic/electric control switch 28. During normal operating conditions, both the normal on/off and alarm control switches 16 and 28 have their atmospheric sides exposed directly to the inside of the second or upper diving bell enclosure 25 via the breather passageway 26. The output electrical control signals from both switches are supplied through an electrical harness network and conductor cable 29 secured to the top of the single container canister comprised by the outer alarm sensor tube 27 and upper diving bell-type enclosure 25.

FIG. 3 of the drawings operates in a manner similar to that described with relation to FIG. 2, with the notable exception that the outer alarm sensor tube 27 has aperture openings 27B formed therein for normally maintaining the pressure side of the alarm pneumatic switch 28 at the atmospheric pressure of the interior of collection tank 11 (not shown in FIG. 3) during normal on/off operation of the sgp system. However, in the case of a breakdown of normal on/off control switch 16 or surge input of collected liquid sewage, that raises the collected sewage level above the openings 27B, air contained in the space between tubes 18 and 27 will be pressurized as the liquid level rises to a sufficiently high value to actuate the alarm control switch 28. In other respects, the canister system of FIG. 3 functions in the same manner as the embodiment of the invention shown in FIG. 2.

Should the liquid level in the collection tank 11 raise sufficiently to close the lower opened mouth of the upper diving bell-type enclosure 25, pressure builds up in the upper diving bell to a point that resists further raising of the level of the liquid within enclosure 25 so as to prevent any flooding of the interior chamber of bell 25 normally accessed through breather tube 26. Hence, flooding of the interior of diving bell 25 and control switches 16 and 28 is prevented. After the alarm level conditions are pumped down by continual operation of the sgp, the liquid level recedes below the lower open end of the diving bell 25 and the system automatically returns to normal on/off operating conditions without requiring the services of maintenance personnel.

FIG. 5 is a partially broken away, longitudinal elevational view of a second and preferred embodiment of the invention wherein only a single bell-type enclosure 25 is provided and within which both the normal on/off and alarm level control switches (best shown in FIG. 6 of the drawing) are supported. The diving bell-type enclosure 25 has an enlarged diameter, upper body member portion depicted by reference numeral 25 and a smaller diameter skirt portion 25A that is integrally formed with and concentrically surrounded by the upper body member portion 25. This provides a circumferentially surrounding lower opening 25L between the two parts 25 and 25A whereby the interior of the upper body member portion 25 is open to the atmosphere in the collection tank via a breather tube 25B. The top, or cap portion, 25C of the diving bell-shaped body member 25 is integrally formed with the enlarged diameter body portion 25 and forms a liquid tight and air tight seal therewith.

The upper, diving bell-shaped body member 25 together with its depending smaller diameter skirt portion 25A has physically mounted therein a sensor tube sub-assembly, the lower portion of which is shown at 18.

FIG. 6 is a side elevational view of the sensor tube sub-assembly which is comprised in part by the smaller diameter sensor tube 18 of about 2 inch inside diameter and which extends down to about 2 inches from the bottom of a sewage collection tank in which the liquid level sensing and control assembly is mounted. At the upper end of the sensor tube 18 an enlarged diameter pedestal portion 31 is integrally formed. At the junction of 31 with the smaller diameter sensor tube 18 an air tight and liquid tight joint is provided. Supported on the upper end of the larger diameter pedestal portion 31 is an O-ring seal 32 which is seated in a suitable O-ring seal groove formed circumferentially around the enlarge diameter pedestal portion 31 near its closed top 33. Secured to the top 33 are mounting brackets 34 for mounting the pneumatic/electric, on/off control electric switch 16 and alarm level control switch 28. It should be noted that, in this embodiment of the invention, as in FIG. 3, the two pneumatic/electric control switches are mounted at the same relative level in a up/down direction within the level sensing control system canister assembly. The control switches 16 and 28 include breather tubes 35 which are exposed to the ambient pressure within the diving bell-type enclosure 25 shown in FIG. 5 of the drawings. Pressurized air developed in the sensor tube 18 is supplied through conduits 18A and 27A to the pressure side of control switches 16 and 28, respectively.

As best shown in FIG. 5, the electrical control and alarm signals developed by the pneumatic/electric control switches 16 and 28 are supplied through the output electrical conduit conductor 29 through a liquid and airtight threaded coupling on the top of the diving bell-shaped body member 25 for the supply of control electric signals to the electric motor of a sewage grinder pump. To assure good electric supply connections, the conductor 29 is clamped to a mounting tube 30 rigidly secured to the top of the diving bell-type enclosure member 25 adjacent to the electrical coupling for conductor 29 by means of tie wraps shown at 37.

Also secured to the upper mounting tube 30 is a mounting support bracket sub-assembly 38 for readily mounting the liquid level sensing assembly canister onto a complimentary-acting canister mounting bracket (not shown) secured to the inside surface of a sewage collection tank in which the canister is to be physically mounted separately from the sewage grinder pump which it is designed to control.

In order to provide positive physical support for the lower end of the small diameter sensor tube 18 other than that provided through the pressure and friction of the O-ring seal 32, a mechanical bale 39 is secured between the lower open mouth portion of the smaller diameter lower skirt portion 25A and the upper end of the smaller diameter sensor tube 18.

For installations in a sewage collection system of the type disclosed in U.S. Pat. No. 4,822,213 issued Apr. 18, 1989, for a "Narrow Accessway Sewage Collection Tank Assembly, etc.", Richard C. Grace et al inventors, and assigned to the Environment One Corporation, it is desirable to provide at the upper end of the short mounting tube 30 either a female or a male threaded coupling 30A for interconnection with a complimentary threaded mounting tube, rod or pipe for inserting the control canister down into the elongated narrow accessway enclosure. In this manner, the improved liquid level sensing system canister assembly readily can be mounted in the sewage collection tank portion of a sewage grinder pump system of the type described in U.S. Pat. No. 4,822,213. This can be done separately from the insertion and mounting of the sewage grinder pump itself as described in the patent. The same threaded coupling 30A also can be used in extracting the canister-type liquid level sensing assembly from its operating position in the sewage collection tank in the event of need for maintenance or other servicing.

In operation, the system shown in FIGS. 5 and 6 functions in essentially the same manner as was described with relation to FIG. 3 of the drawing. The fact that the pneumatic/electric, on/off control switch 16 is mounted at the same physical height as the alarm level control switch 28 makes no difference in the operation of the system since the alarm level control switch 28 is calibrated to operate over a higher pressure portion of the range of operation of the switches relative to the normal on/off operation controlled by switch 16. With respect to both pneumatic operated switches, the pneumatic pressure conveyed up through the single sensor tube 18 is applied to both switches simultaneously through their respective inlet conduit tubes 18A or 27A. While operating at the lower pressure ranges, corresponding to lower liquid levels in the sewage collection tank, alarm control switch 28 will not respond and hence remains off. Correspondingly, at the higher pressure levels corresponding to alarm and high liquid levels within the sewage collection tank, the normal on/off control switch just remains on (if it is operable) and the alarm control switch 28 turns on as a redundant back up to the normal on/off switch 16 in case of switch 16's failure. Additionally, the alarm control switch also serves to operate a light as well as a buzzer in the home of a user of the system to indicate to the user the existence of a high sewage liquid level alarm condition. As the high liquid level is pumped out of the sewage collection tank, the alarm pneumatic/electric switch will turn off at some lower alarm turn-off level slightly above the turn on point of the normal on/off control switch 16.

In case of failure of both the normal turn-on/turn-off and alarm control switches, as the sewage level rises up to and closes the open lower end of inverted diving bell-type enclosure 25, compressed air pressure builds up within the enclosure and prevents entry of the liquid sewage into enclosure 25 in which the control switches 16 and 28 are mounted.

Figure 7:
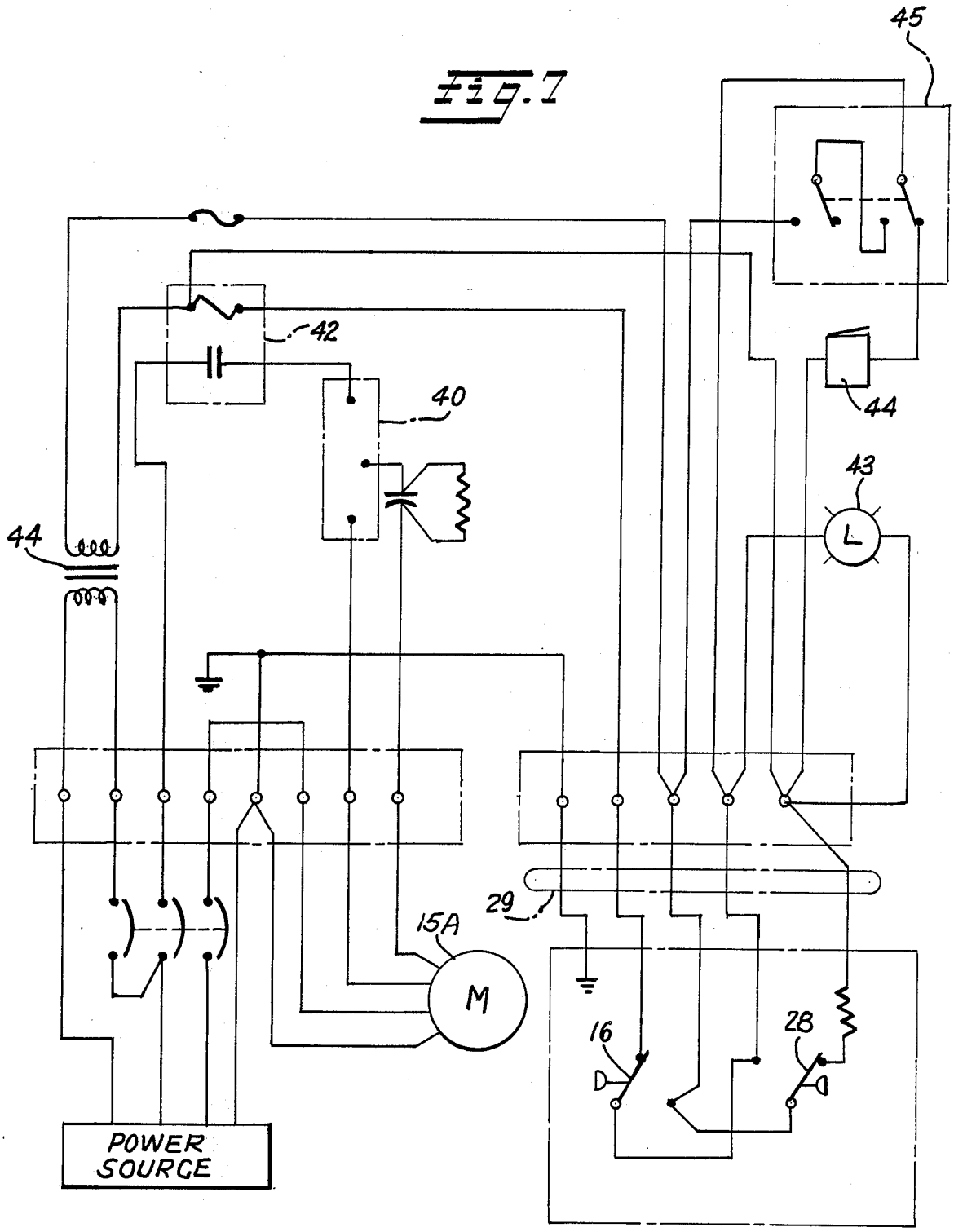
FIG. 7 is a schematic electrical diagram showing the electrical interconnection of both a normal operating high water/low water, on/off, pneumatic/electric control switch and an alarm level control switch interconnected with the pump motor for providing redundant operation of the pump motor during intervals while alarm high water level conditions exist in a sewage collection tank.

FIG. 7 of the drawings is a detailed schematic electric circuit diagram of the interconnection wiring between the on/off control switch 16 and the alarm level control switch 28 and the drive motor 15A for the sewage grinder pump 15. From FIG. 7 it will be seen that the control switches 16 and 28 contained within control canister 25 are supplied with low power level 12 volt excitation signals via a step-down transformer. The control switches 16 and 28 control the application of 240 volt, single phase 60 Hertz power level current to the pump motor 15A via a starting relay 42. The on/off switch contact of control switches 16 and 28 are also interconnected to an alarm light 43 as well as an alarm buzzer 44 having a silencing switch 45 connected with it. The alarm light 43, alarm buzzer 44 and its silencing switch are normally mounted in the household of a residence in which the sewage grinder pump system is installed.

Past sewage grinder pump systems employed the high level alarm pneumatic/electric control switch 28 only to light the alarm light 43 and sound the buzzer 44 without interacting with or affecting operation of the motor. By interconnecting the two pneumatic/electrical control switches 16 and 28 according to the invention in the manner shown in FIG. 7, actuation of the alarm level control switch 28 to position its moveable contact on the fixed contact on which it is shown closed in FIG. 7, will serve to light the alarm light 43 and activate buzzer 44. If the sgp on/off master switch 40 is closed, the circuit of FIG. 7 also will supply holding current through the power relay 42, causing it to continue to supply electric power to motor 15A in the event that the normal on/off sewage level control switch 16 malfunctions or closes on its off contact (as shown in FIG. 7) under conditions where it is desirable that the pump motor 15 continue to operate. In this manner, the installation will continue to pump down the liquid level content in the sewage collection tank from a high level alarm condition to its alarm turnoff level. The system will then oscillate on and off between the alarm high level and the alarm turn-off level until such time that the alarm light and buzzer are noted by the residents of the building in which the sgp system is installed, and a serviceman is brought in to determine what caused the normal on/off level control switch 16 to malfunction and corrects it.

From the foregoing description, it will be appreciated that the present invention provides a novel sewage grinder pump liquid level control system contained within a single canister wherein pneumatically operated electric control switches for controlling both normal on/off operation of the sewage grinder pump and alarm level operation, are physically supported within a sewage collection tank separately from the sewage grinder pump. The canister includes a diving bell-type containment vessel within which the pneumatically operated electric control switches are mounted for preventing flooding of the electric control switches in case of surges or failure of the primary on/off control switch and filling of the sewage collection tank to or above an alarm level. The invention also makes available a new and improved interconnection of the alarm level pneumatic/electric control switch so that in the event of failure of the normal liquid level on/off sewage grinder pump control electric switch, redundant excitation of the sewage grinder pump motor is provided during alarm high water level conditions and the system is caused to pump down the contents of the sewage collection tank despite the failure of the normal on/off operating control to do so.

INDUSTRIAL APPLICABILITY

The invention provides a new and improved anti-flooding sewage grinder pump liquid level control system in a separately mounted canister for use in sewage grinder pump installed in residences, commercial and industrial buildings where pressurized sewage systems are employed due to the non-availability of a gravity drain sewage system.

Having described several embodiments of an anti-flooding sewage grinder pump liquid level control system in separately mounted canister constructed in accordance with the invention, it is believed obvious that other modifications and variations of the invention will be suggested to those skilled in the art in the light of the above teachings. It is therefore to be understood that changes may be made in the particular embodiments of the invention described which are within the full intended scope of the invention as defined by the appended claims.

What is claimed is:

1. In a sewage grinder pump system having a collection tank and a sewage grinder pump driven by an electric motor disposed therein for grinding and discharging sewage collected in the tank under pressure through a pressurized sewage discharge outlet, the improvement comprising:

first pneumatically and electrically operable liquid sewage level sensing and control means calibrated for sensing a normal operating high and low liquid sewage level within the collection tank and automatically electrically exciting the sewage grinder pump electric motor to cause the pump to grind and pump down sewage collected in the tank to a normal low operating level;

second pneumatically and electrically operable alarm liquid sewage level sensing and control means calibrated for sensing an alarm high liquid sewage level within the collection tank which is higher than the normal high operating liquid sewage level and representative of overfilling of the collection tank due to a malfunction or surge overload, said second alarm liquid sewage level sensing and control means being electrically connected to and automatically providing an alarm operating condition output indication signal to an operator of the sewage grinder pump system; and means for physically mounting both said first normal liquid sewage level sensing and control means and said second alarm liquid sewage level sensing and control means within liquid-tight and airtight diving bell-type enclosure means having an open lower end thereof exposed to and normally closed by the upper level of the collected liquid sewage contained in the sewage collection tank during both normal operating conditions and alarm high liquid sewage level operating conditions.

2. A sewage grinder pump liquid level sensing and control system according to claim 1 wherein the second alarm liquid sewage level sensing and control means also is electrically connected to and operates the sewage grinder pump motor in a redundant manner under conditions where flooding of the sewage collection tank to the alarm high level occurs due to a malfunction in the first normal operating liquid sewage level sensing and control means or otherwise.

3. A sewage grinder pump liquid level sensing and control system according to claim 2 wherein a single liquid and airtight diving bell-type enclosure means is provided with both the first normal operating liquid sewage level sensing and control means and the second alarm high liquid sewage level sensing means being mounted therein near the closed upper end of the liquid-tight and airtight diving bell-type enclosure means and liquid entering the lower open end causes compression of air trapped in the enclosure means whereby the pneumatically operated normal operating high and low liquid sewage level sensing and control means and the alarm high liquid sewage level sensing and control means are sequentially operated as liquid sewage collected in the tank rises to the normal operating high level, or in the event of breakdown, to a alarm high level and due to the compressed air trapped in the diving bell-type enclosure means the liquid level sensing and control means are not flooded during either normal or alarm operating conditions.

4. A sewage grinder pump liquid level sensing and control system according to claim 3 wherein the components of the liquid level sensing and control system are mounted in the sewage collection tank separately from the sewage grinder pump and are only electrically interconnected with the sewage grinder pump electric motor whereby the liquid level sensing and control system can be physically removed and separately serviced through the top of the sewage collection tank without having to remove the sewage grinder pump and its motor.

5. A sewage grinder pump liquid level sensing and control system according to claim 4 wherein the liquid level sensing and control system including the liquid-tight and airtight diving bell-type enclosure means is designed to be separately readily installed and subsequently removed for servicing when required from the top of the sewage collection tank by means of remote operated slide coupling means for separately physically supporting the liquid level sensing and control system at a predetermined design level within the sewage collection tank.

6. A sewage grinder pump liquid level sensing and control system according to claim 5 wherein the liquid-tight and airtight diving bell-type enclosure means is formed in the shape of a single canister enclosing all of the components of the liquid level sensing and control system.

7. A sewage grinder pump liquid level sensing and control system according to claim 2 wherein the liquid-tight and airtight diving bell-type enclosure means is comprised by two physically separate upper and lower bell-type enclosures with the upper end of the lower bell-type enclosure communicating through an air passageway with the pneumatically operated first normal operating liquid sewage level sensing and control means and the second higher diving bell-type enclosure communicating through an air passageway with the second alarm high level liquid sewage level sensing and control means.

8. A sewage grinder pump liquid level sensing and control system according to claim 7 wherein the sensing components of the liquid level sensing and control system are mounted in the sewage collection tank separately from the sewage grinder pump and are only electrically interconnected with the sewage grinder pump electric motor whereby the liquid level sensing and control system can be physically removed and separately serviced through the top of the sewage collection tank without having to remove the sewage grinder pump and its motor.

9. A sewage grinder pump liquid level sensing and control system according to claim 8 wherein the liquid level sensing and control system including the liquid-tight and airtight diving bell-type enclosure means is designed to be separately readily installed and subsequently removed for servicing when required from the top of the sewage collection tank by means of remote operated slide coupling means for separately physically supporting the liquid level sensing and control system at a predetermined design level within the sewage collection tank.

10. A sewage grinder pump liquid level sensing and control system according to claim 9 wherein the liquid-tight and airtight diving bell-type enclosure means is formed in the shape of a single canister enclosing all of the components of the liquid level sensing and control system.

11. A sewage grinder pump liquid level sensing and control system according to claim 2 wherein the components of the liquid level sensing and control system are mounted in the sewage collection tank separately from the sewage grinder pump and are only electrically interconnected with the electric motor of the sewage grinder pump whereby the liquid level sensing and control system can be physically removed and separately serviced through the top of the sewage collection tank without having to remove the sewage grinder pump and its motor.

12. A sewage grinder pump liquid level sensing and control system according to claim 11 wherein the liquid level sensing and control system including the liquid-tight and airtight diving bell-type enclosure means is designed to be separately readily installed and subsequently removed for servicing when required from the top of the sewage collection tank by means of remote operated slide coupling means for separately physically supporting the liquid level sensing and control system at a predetermined design level within the sewage collection tank.

13. A sewage grinder pump liquid level sensing and control system according to claim 12 wherein the liquid-tight and airtight diving bell-type enclosure means is formed in the shape of a single canister enclosing all of the components of the liquid level sensing and control system.

14. A sewage grinder pump liquid level sensing and control system according to claim 1 wherein the liquid-tight and airtight diving bell-type enclosure means is comprised by two physically separate upper and lower bell-type enclosures with the upper end of the lower bell-type enclosure communicating through an air passageway with the pneumatically operated first normal operating liquid sewage level sensing and control means and the second higher diving bell-type enclosure communicating through an air passageway with the second alarm high level liquid sewage level sensing and control means.

15. A sewage grinder pump liquid level sensing and control system according to claim 1 wherein the components of the liquid level sensing and control system are mounted in the sewage collection tank separately from the sewage grinder pump and are only electrically interconnected with the electric motor of the sewage grinder pump whereby the liquid level sensing and control system can be physically removed and separately serviced through the top of the sewage collection tank without having to remove the sewage grinder pump and its motor.

16. A sewage grinder pump liquid level sensing and control system according to claim 15 wherein the liquid level sensing and control system including the liquid-tight and airtight diving bell-type enclosure means is designed to be separately readily installed and subsequently removed for servicing when required from the top of the sewage collection tank by means of remote operated slide coupling means for separately physically supporting the liquid level sensing and control system at a predetermined design level within the sewage collection tank.

17. A sewage grinder pump liquid level sensing and control system according to claim 16 wherein the liquid-tight and airtight diving bell-type enclosure means is formed in the shape of a single canister enclosing all of the components of the liquid level sensing and control system.

18. A sewage grinder pump liquid level sensing and control system according to claim 1 wherein a single liquid and airtight diving bell-type enclosure means is provided with both the first normal operating liquid sewage level sensing and control means and the second alarm high liquid sewage level sensing and control means being mounted therein near the closed upper end of the liquid-tight and airtight diving bell-type enclosure means and liquid entering the lower open end causes compression of air trapped in the enclosure means whereby the pneumatically operated normal operating high and low liquid sewage level sensing and control means and the alarm high liquid sewage level sensing and control means are sequentially operated as liquid sewage collected in the tank rises to the normal high operating level, or in the event of breakdown, to a alarm high level and, due to the compressed air trapped in the diving bell-type enclosure means, the liquid level sensing and control means are not flooded during either normal or alarm operating conditions.

19. In a sewage pump system having a collection tank and a sewage pump driven by an electric motor disposed therein for pumping and discharging sewage collected in the tank under pressure through a pressurized sewage discharge outlet, the improvement comprising:

first pneumatically and electrically operable liquid sewage level sensing and control means calibrated for sensing a normal operating high and low liquid sewage level within the collection tank and automatically electrically exciting the sewage pump electric motor to cause the pump to pump down sewage collected in the tank to a normal low operating level;

second pneumatically and electrically operable alarm liquid sewage level sensing and control means calibrated for sensing an alarm high liquid sewage level within the collection tank which is higher than the normal high operating liquid sewage level and representative of overfilling of the collection tank due to a malfunction or surge overload, said second alarm liquid sewage level sensing and control means being electrically connected to and automatically providing an alarm operating condition output indication signal to an operator of the sewage pump system; and means for physically mounting both said first normal liquid sewage level sensing and control means and said second alarm liquid sewage level sensing and control means within liquid-tight and airtight diving bell-type enclosure means having an open lower end thereof exposed to and normally closed by the upper level of the collected liquid sewage contained in the sewage collection tank during both normal operating conditions and alarm high liquid sewage level operating conditions.

20. A sewage pump liquid level sensing and control system according to claim 19 wherein the second alarm liquid sewage level sensing and control means also is electrically connected to and operates the sewage pump motor in a redundant manner under conditions where flooding of the sewage collection tank to the alarm high level occurs due to a malfunction in the first normal operating liquid sewage level sensing and control means or otherwise.

* * * * *